US006911769B2

(12) United States Patent
Antonelli et al.

(10) Patent No.: US 6,911,769 B2
(45) Date of Patent: Jun. 28, 2005

(54) LATERAL MAGNETIC SHIELDING FOR COLOR CRT

(75) Inventors: Goffredo Antonelli, Anagni (IT); Cesare De Paolis, Collefferro (IT); Giuseppe Giannantonio, Anagni (IT); Paolo Ginesti, Gavignano (IT)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 10/381,404

(22) PCT Filed: Sep. 20, 2001

(86) PCT No.: PCT/EP01/10883

§ 371 (c)(1),
(2), (4) Date: Mar. 24, 2003

(87) PCT Pub. No.: WO02/29846

PCT Pub. Date: Apr. 11, 2002

(65) Prior Publication Data

US 2003/0189397 A1 Oct. 9, 2003

(30) Foreign Application Priority Data

Oct. 3, 2000 (IT) ..... MI00A2135

(51) Int. Cl.[7] ..... H01J 29/80
(52) U.S. Cl. ..... 313/402; 313/407; 313/313
(58) Field of Search ..... 313/402, 407, 313/313

(56) References Cited

U.S. PATENT DOCUMENTS

| | | | | |
|---|---|---|---|---|
| 4,949,008 A | | 8/1990 | Chihara | 313/402 |
| 6,448,702 B1 | | 9/2002 | Kamada et al. | 313/402 |
| 6,727,638 B2 | * | 4/2004 | De Paolis et al. | 313/407 |
| 2002/0030429 A1 | | 3/2002 | Yang | 313/402 |
| 2002/0171350 A1 | | 11/2002 | Kim et al. | 313/407 |

FOREIGN PATENT DOCUMENTS

| | | | |
|---|---|---|---|
| EP | 602620 | 6/1994 | H01J/29/07 |
| JP | 6-243794 | 9/1994 | H01J/29/02 |
| JP | 7-122200 | 5/1995 | H01J/29/02 |
| JP | 10-247459 | 9/1998 | H01J/29/02 |
| JP | 11-329275 | 11/1999 | H01J/29/02 |
| JP | 2001-23533 | 1/2001 | H01J/29/02 |
| JP | 2001-196015 | 7/2001 | H01J/31/00 |

OTHER PUBLICATIONS

Patent Abstracts of Japan, vol. 1995, No. 8, Sep. 29, 1995 and JP 7–122200.
Patent Abstracts of Japan, vol. 2000, No. 2, Feb. 29, 2000 And JP 11–329275.
Patent Abstracts of Japan, vol. 18, No. 626, Nov. 29, 1994 And JP 6–243794.
Patent Abstracts of Japan, vol. 1998, No. 14, Dec. 31, 1998 And JP 10–247459.
Patent Abstracts of Japan, vol. 2000, No. 24, May 2001 and JP 2001–196015.
Patent Abstracts of Japan, vol. 2000. No. 16, May 8, 2000 and JP 2001–023533.

* cited by examiner

*Primary Examiner*—Vip Patel
(74) *Attorney, Agent, or Firm*—Joseph S. Tripoli; Harvey D. Fried; Patricia A. Verlangieri

(57) ABSTRACT

Color cathode-ray tube comprising a color selection mask (16) held under tension between a first pair of opposed long sides (30) of an approximately rectangular metal frame (21), a main magnetic screen (22) placed at the rear of the frame in the funnel-shaped part (11) of the tube's envelope, and additional means (50) for forming a screen against the Earth's magnetic field in the part lying along the second pair of opposed short sides of the frame.

4 Claims, 3 Drawing Sheets

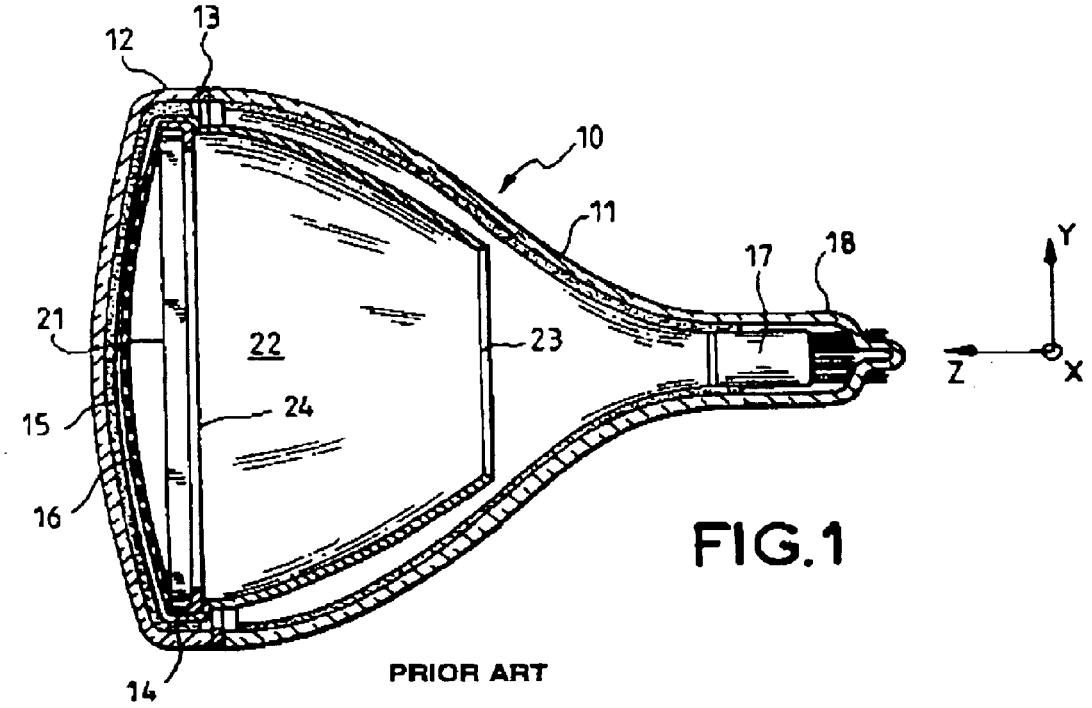
FIG.1
PRIOR ART
FIG. 2
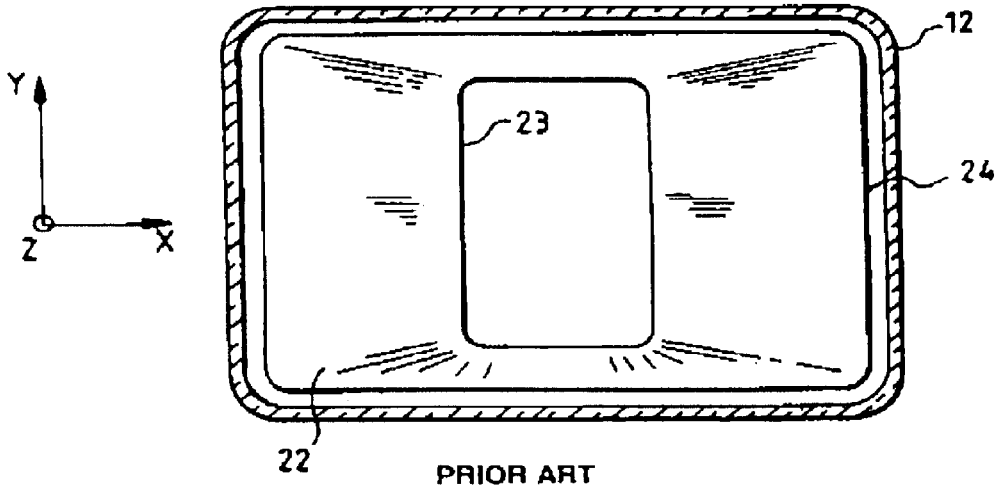
PRIOR ART

LATERAL MAGNETIC SHIELDING FOR COLOR CRT

BACKGROUND OF THE INVENTION

The subject of the present invention is a color cathode-ray tube having an internal magnetic screen, and more particularly a cathode-ray tube whose color selection mask is held under tension by a support frame.

A color cathode-ray tube is composed of a glass envelope comprising an approximately rectangular front face joined to a funnel-shaped part terminating in a cylindrical neck. An electron gun is placed in the neck and generates electron beams intended to form a color image on a luminescent screen placed on the internal surface of the front panel. The electron beams are kept in correspondence with the phosphors of the luminescent screen by means of a perforated metal mask called the color selection mask. The mask is attached to an approximately rectangular rigid frame with two pairs of opposed sides—a pair of short sides and a pair of long sides. An internal magnetic screen is generally placed in the funnel-shaped part of the envelope and is joined to the rear of the frame. The primary objective of this magnetic screen is to reduce the influence of the components of the Earth's magnetic field on the trajectories of the electron beams so that the angles of incidence of the said beams on the selection mask are not significantly modified by these components; if this were not so, the points of impact of the beams on the screen would be moved and illuminate phosphors of a color other than that desired.

SUMMARY OF THE INVENTION

The magnetic screens of the prior art are designed to have a shape matching as closely as possible the internal surface of the funnel-shaped part of the envelope, with openings. The shape and number of openings are specifically designed, for particular types of tubes, to counteract the Earth's field prevent the beams from illuminating the incorrect phosphor.

However, it was apparent that tubes incorporating a mask held under tension between two opposed sides of a frame had a greater sensitivity to the Earth's magnetic field and that the magnetic screens of the prior art could not provide a solution to this sensitivity problem.

This sensitivity seems to be problematic in tubes whose mask is held under tension between two opposed sides of the frame and whose other two sides have a free edge extending towards the screen, the end of which is placed beneath the surface of the mask. This frame structure is generally used because this structure makes it possible, among other things, to lighten the frame/mask assembly and to reduce its material cost, since it is not necessary for the heights of the long and short sides to be identical in order for the frame to fulfil its mechanical functions.

The tube according to the invention does not have this sensitivity to the Earth's magnetic field and to achieve this it comprises a glass envelope having a front face inside which is a luminescent screen, the said front face being sealed to a funnel-shaped part, a color selection mask placed so as to face the luminescent screen and held under tension by an approximately rectangular frame having a pair of long sides and a pair of short sides, the mask being fixed under tension to a first pair of opposed sides, the edges of the sides of the frame which constitute the second pair extending towards the screen and lying beneath the surface of the mask, and a main magnetic screen fixed to the frame and extending to the rear of the funnel-shaped part of the tube's envelope,wherein the tube includes complementary means for making a screen against the Earth's magnetic field, these means being placed so as to cover, at least partially, the open space between the edges of the second pair of sides and the surface of the mask.

BRIEF DESCRIPTION OF THE DRAWINGS

The invention and its advantages will be more clearly understood from the description below and from the drawings among which:

FIG. 1 shows, in section, a cathode-ray tube according to the prior art;

FIG. 2 shows a magnetic screen according to the prior art;

DETAILED DESCRIPTION

Figure 3:
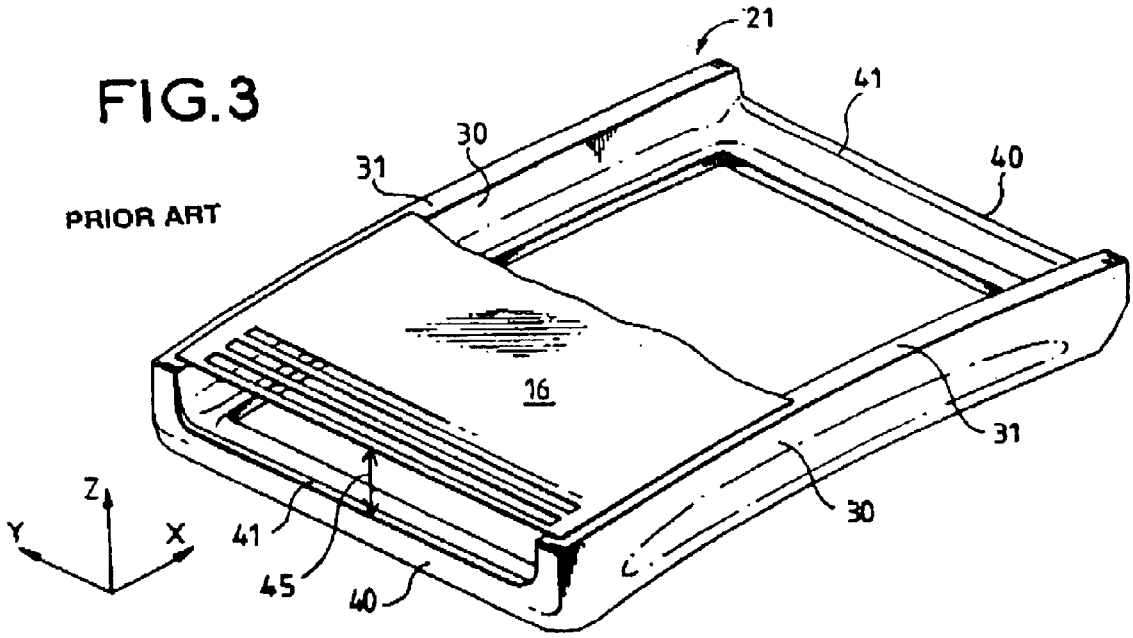
FIG.3 PRIOR ART
FIG. 3 shows, in perspective, a frame/tensioned-mask assembly.

FIG. 1 illustrates a cathode-ray tube 10 comprising a funnel-shaped part 11 and an approximately rectangular front face 12, the two parts being joined together by means of a glass frit seal 13. A luminescent screen 15 is deposited on the internal surface of the front face 12. The luminescent screen 15 is composed of three arrays of luminescent materials emitting in the three primary colors—red, green and blue—when they are excited by the three electron beams output by the electron gun 17 placed in the cylindrical neck 18. A color selection electrode 16 is held at a precise distance from the screen 15 by a frame 21 whose cross section is generally in the form of an L. The electrode 16 keeps the three electron beams output by the gun 17 in correspondence with the three arrays of luminescent materials. The electrode 16 includes a peripheral skirt 14 to be inserted inside the edges of the frame 21 extending towards the screen 15.

Because electrons are charged particles, the electron beams output by the gun 17 are liable to be deflected by the Earth's magnetic field. As a result, depending on the orientation of the tube 10 with respect to the Earth's magnetic field, the electron beams may illuminate phosphors of an array not corresponding to them, causing discoloration of the image formed on the screen of the tube. These tubes therefore have problems called register problems. The effects of the Earth's magnetic field are conventionally minimized by a magnetic screen 22 placed inside the tube along the path of the electron beams, that is to say in the funnel-shaped part 11. This magnetic screen 22, as illustrated for example in FIG. 2, has a rear opening 23 and a front opening 24 to be attached to the perimeter of the frame 21 by soldering or welding or by clips.

The color selection electrode 16, the frame 21 and the magnetic screen 22, all manufactured from ferromagnetic alloys, have hitherto provided protection against the Earth's magnetic field. However, it seems that the latest generations of tubes 10 with a flat front face 12, in which the color selection electrode 16 is tensioned along a direction, for example along the vertical direction Y, are very sensitive to the Earth's magnetic field.

The frame/mask structure of these tubes is illustrated in FIG. 3.

The frame 21, of approximately rectangular shape, comprises a pair of vertical short sides 40 and a pair of horizontal long sides 30. The sides of the frame 21 have an L-shaped cross section and the color selection mask 16 is held under tension by welding or soldering its horizontal edges to first edges 31 of the frame 21 on the long sides 30. In order to minimize the weight of the frame 21, the short sides 40 have a smaller height than that of the long sides 30. As such, second edges 41 of the frame 21 on said short sides 40 which lie below the mask 16 leave a gap 45 in the Z direction perpendicular to the surface of the color selection electrode 16 between the second edges 41.

Within the context of the invention, it has been demonstrated that the register problems of the tubes incorporating this type of frame/mask structure were due to high sensitivity to the horizontal component of the magnetic field. It was discovered that this sensitivity arose from the unprotected gap 45 between the color selection electrode 16 and the second edges 41 of the frame 21.

Figure 4:
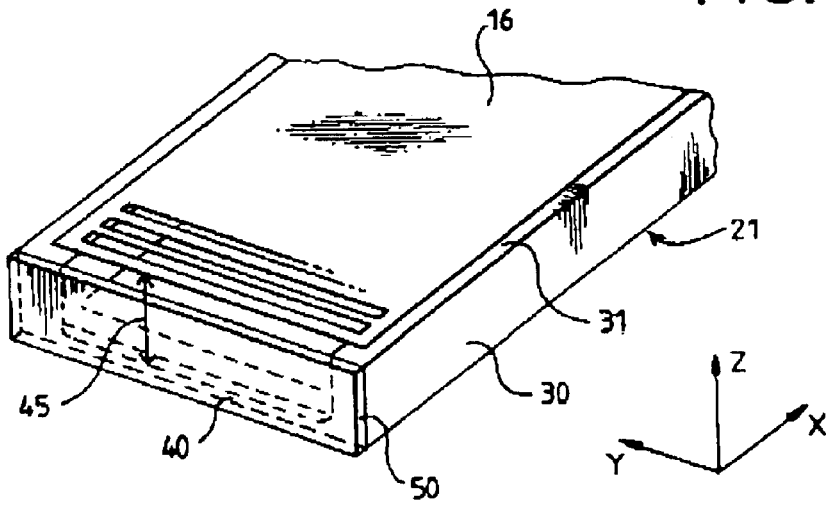
FIG. 4 shows, in perspective, a first embodiment of the invention.

In order to screen against this horizontal component, two ferromagnetic metal plates 50 are placed for example inside the tube 10, each along each vertical short side 40, in the gap 45 so as to cover, preferably completely, the said gap 45. This embodiment is illustrated in FIG. 4 in which the metal plates 50 are held in place by being soldered or welded to the vertical short sides 40 of the frame 21. This arrangement is not limiting as to the metal plates 50: metal plates 50 may also, advantageously, be placed outside the tube, along the vertical short sides, so as to cover the gap 45. The plates 50 may be made either of the same material as the main magnetic screen 22 or in any ferromagnetic material.

Figure 5:
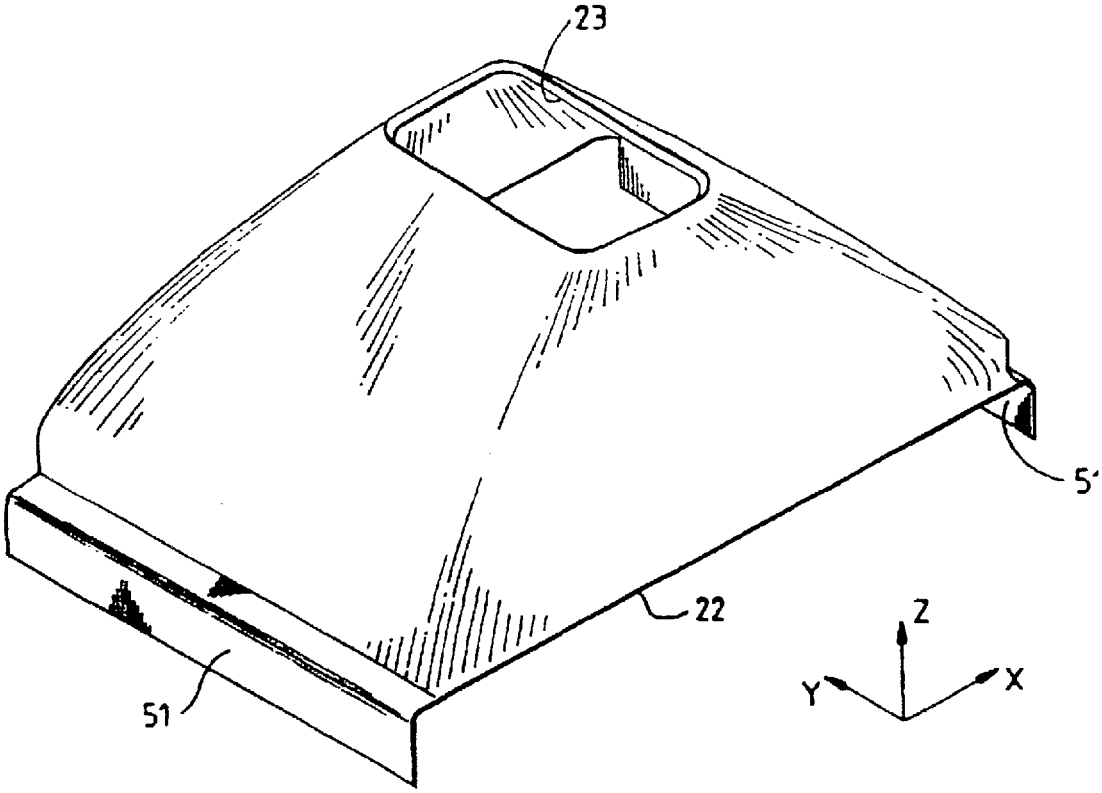
FIG. 5 illustrates a second embodiment of the invention.

In the alternative embodiment in FIG. 5, the magnetic screen 22 comprises at least two lateral flanges 51 extending towards the screen 15 and intended to cover the short sides 40 of the frame 21 and, in particular, the gap 45. This embodiment is advantageous since it does not require additional pieces to protect against the horizontal component of the Earth's magnetic field.

The table below illustrates the improvements with regard to the register (deviation measured at specific points on the luminescent screen 15 between the phosphor and the point of impact of the electron beam corresponding to it) which are obtained by the lateral magnetic flanges 51 according to the invention, compared with the same frame/mask structure not having these lateral magnetic flanges 51.

| Variation of the magnetic field | Position of the measurement point | Register without the lateral flanges (in mils) | Register with the lateral flanges (in mils) | Improvement due to the lateral flanges |
|---|---|---|---|---|
| Vertical: 380 mG | Corner | 0.4 | 0.3 | Slight |
| Vertical: 380 mG | Between corner and 3 o' clock | −0.5 | −0.4 | Slight |
| Vertical: 380 mG | 3 o' clock | 0 | 0 | Unchanged |
| Horizontal along Z | | | | |
| 500 mG | Corner | 0.8 | 0.5 | 40% |
| 500 mG | Between corner and o' clock | 1.6 | 0.9 | 43% |
| Horizontal along X | | | | |
| 500 mG | Corner | 1.6 | 0.9 | 43% |
| 500 mG | Between corner and 3 o' clock | 2.3 | 1.2 | 47% |

The 3 o'clock measurement point conventionally corresponds to the middle of the vertical peripheral edge of the luminescent screen.

These results are obtained under the following test conditions:

firstly, the tube 10 is subjected to a magnetic field variation in the vertical direction of about 380 milligauss;

secondly, the tube 10 is subjected to horizontal field variations of 500 mG along the main axis Z of the tube 10 and then along the horizontal axis X so as to check the variations in register when the receiver incorporating the tube 10 has its orientation changed.

After each measurement, the tube 10 is degaussed in a manner equivalent to the degaussing undergone by the receiver after each tensioning.

The invention provides an appreciable improvement in the performance of the tube 10 against the Earth's magnetic field, and most of all against the horizontal component, which makes it possible to obtain a suitable register whatever the orientation of the image screen.

The invention may also apply in the same way if the color selection electrode 16 is held under tension between the short sides 40 of the frame 21 and there is another gap between the edges 31 of the long sides 30 and the surface of the color selection electrode 16. In this case, the additional means will have to be placed so as to cover this gap in order to screen against the vertical component of the Earth's magnetic field.

What is claimed is:

1. Cathode-ray tube in the form of a glass envelope comprising a front face inside which is a luminescent screen, the said front face being sealed to a funnel-shaped part, a color selection electrode placed so as to face the luminescent screen and held under tension by an approximately rectangular frame having a first pair of long sides and a second pair of short sides, the color selection electrode being fixed under tension to the first pair of long sides, edges of the frame which constitute the second pair of short sides extending towards the screen and lying beneath the surface of the color section electrode, the edges of the second pair of short sides and the surface of the color selection electrode have an open space therebetween, and a main magnetic screen fixed to the frame and extending to the rear of the funnel-shaped part of an envelope of the cathode-ray tube, wherein the cathode-ray tube includes complementary means for making a screen against the Earth's magnetic field, these means being placed so as to cover, at least partially, the open space between the edges of the second pair of short sides and the surface of the color selection electrode.

2. The cathode-ray tube of claim 1, wherein the complementary means including at least two metal plates along the edges of the short sides.

3. Cathode-ray tube as claimed in claim 1, wherein the complementary means having at least two flanges formed as one piece with the main magnetic screen.

4. The cathode-ray tube of claim 2, wherein the additional metal plates being made from the same material as the main magnetic screen.

* * * * *